US006023144A

United States Patent [19]

Imai et al.

[11] Patent Number: 6,023,144

[45] Date of Patent: Feb. 8, 2000

[54] DRIVE CONTROL METHOD FOR A MOTOR AND AN APPARATUS THEREFOR

[75] Inventors: Yukie Imai; Minoru Takahashi; Jouji Matsumoto, all of Omiya, Japan

[73] Assignee: Mitsubishi Materials Corporation, Tokyo, Japan

[21] Appl. No.: 08/738,354

[22] Filed: Oct. 25, 1996

[30] Foreign Application Priority Data

Oct. 25, 1995 [JP] Japan ..... 7-278088

[51] Int. Cl.[7] ..... G05D 23/00

[52] U.S. Cl. ..... 318/641; 388/934; 165/16; 165/209

[58] Field of Search ..... 318/641; 388/934; 165/16, 209

[56] References Cited

U.S. PATENT DOCUMENTS 4,890,666 1/1990 Clark ..... 165/16
5,544,697 8/1996 Clark ..... 165/209
5,580,334 12/1996 Minowa et al. ..... 165/16 X

*Primary Examiner*—Karen Masih
*Attorney, Agent, or Firm*—Armstrong, Westerman, Hattori, McLeland & Naughton

[57] ABSTRACT

A motor drive control method and an apparatus therefor in a motor used in an adjusting device for adjusting a physical amount such as a temperature of a heat-generating member, wherein a load on a bearing of the motor caused by frequently repeating drive/stop of the motor can be reduced; thereby, prolonging the service life of the motor. The temperature of the heat-generating member is detected by a temperature detection sensor. A comparison calculating unit calculates a temperature change rate $K_n$ or the like in order to recognize the temperature of the heat-generating member and a change state (such as, a temperature change rate), and selects a rotating speed change characteristic appropriate for the change state at such time. An indication signal for changing the rotating speed of the motor on the basis of the selected characteristic is outputted to a motor control driver in order to perform drive control for the motor. In this manner, drive/stop of the motor can be avoided from being frequently repeated, and a load on the bearing of the motor is reduced.

9 Claims, 8 Drawing Sheets

CHARA. = CHARACTERISTIC

CHARA. = CHARACTERISTIC

CHARA. = CHARACTERISTIC

| RATIO OF TEMPERATURE CHANGE RATES | METHOD OF SELECTING TEMPERATURE DETECTION TIME |
|---|---|
| $\lvert Kn\rvert/\lvert Kn-1\rvert > 1$ | $tn-tn-1 < tn-1-tn-2$ |
| $\lvert Kn\rvert/\lvert Kn-1\rvert = 1$ | $tn-tn-1 = tn-1-tn-2$ |
| $\lvert Kn\rvert/\lvert Kn-1\rvert < 1$ | $tn-tn-1 > tn-1-tn-2$ |

DRIVE CONTROL METHOD FOR A MOTOR AND AN APPARATUS THEREFOR

BACKGROUND OF THE INVENTION

1. Field of the Invention

The present invention relates to a drive control method for a motor used in a CPU cooling device or the like, and to an apparatus therefor.

2. Description of the Relevant Art

A CPU cooling fan motor in which an oil bearing is used as a bearing for necessity of miniaturization is proposed. The service life of the oil bearing is shorter than that of a ball bearing; and such service life becomes short with an increase in load on the bearing. The service life of a motor depends on the service life of the bearing. Therefore, a load on the bearing is desirably avoided.

For this reason, m a conventional cooling fan, the temperature of a heat-generating member (such as, a CPU) is detected every predetermined period of time; and when the detection value becomes larger than a predetermined threshold value, the motor is driven to cool the heat-generating member. When the temperature detection value becomes smaller than the threshold value by cooling, rotation of the motor is stopped; thereby, interrupting the cooling operation. More specifically, a temperature range in which the heat-generating member must be cooled, and rotation/stop of the motor is controlled as needed; thereby, making a load on the bearing lower than that in a case wherein the motor is continuously rotated for a long period of time. With such structural arrangement, the service life of the motor is designed be prolonged.

In the above-described conventional motor drive control, only the rotation/stop of the motor is controlled by comparing a predetermined threshold value and a temperature detection value. For this reason, when the temperature of a CPU or the like to be cooled sharply changes, and the drive/stop of the motor is frequently repeated, an instantaneous impact generated when the motor is driven to start its rotation or when the motor in a rotating state is stopped increases a load acting on the bearing. Therefore, the load on the bearing in this case is similar to the bearing in a case whereby the motor is continuously rotated, and the conventional motor drive control has a problem in that the service life of the motor cannot be prolonged.

SUMMARY OF THE INVENTION

The present invention has been made in consideration of these circumstances, and has as its object to provide a drive control method for a motor in which a load on a bearing is reduced by avoiding frequent repetition of a drive/stop of the motor in order to make it possible to prolong the motor's service life, and to provide an apparatus therefor.

According to the first aspect of the present invention, there is provided a drive control method for a motor used in an adjusting device for adjusting a predetermined physical amount. Such drive control method includes the steps of detecting the physical amount for every predetermined period of time and calculating a change rate of the detected physical amount, with respect to respective change states of the change rates; selecting a rotating speed change characteristic corresponding to the change state of the calculated change rate from rotating speed change characteristics of the motor determined to adjust the physical amount; and controlling drive of the motor on the basis of the selected rotating speed change characteristic.

According to the second aspect of the present invention, there is provided a drive control method for a motor according to the first aspect. Such drive control method includes the steps of storing a predetermined threshold value of the physical amount, the physical amount detected every predetermined period of time, and the calculated change rate and rotating speed of the motor in a predetermined storage device; newly calculating the change rate on the basis of the newly detected physical amount and the physical amount stored in the storage means and previously obtained at the predetermined period of time; and calculating a difference between the newly calculated change rate and the change rate stored in the storage means and obtained at the predetermined period of time. The drive control method further includes the steps of calculating a difference between the newly detected physical amount and the threshold value stored in the storage means; and recognizing a change state of the change rate. The recognition of such change state of the change rate is based on the newly calculated change rate, the change rate previously obtained at the predetermined period of time and stored in the storage device, the difference between the change rates, and the difference between the newly detected physical amount and the threshold value to select the rotating speed change characteristic.

According to the third aspect of the present invention, there is provided a drive control method for a motor according to the first or second aspect. In such a drive control method, the predetermined period of time is set to be a short period of time when the change rate sharply changes, and the predetermined period of time is set to be a long period of time when the change rate moderately changes.

According to the fourth aspect of the present invention, there is provided a drive control method for a motor according to any one of the first to third aspects. In such a drive control method, the adjusting device is a cooling fan having a fan rotated by the motor, and the physical amount is a temperature of a heat-generating member cooled by the cooling fan.

According to the fifth aspect of the present invention, there is provided a drive control apparatus for a motor used in an adjusting device for adjusting a predetermined physical amount. Such drive control apparatus includes detection device for detecting the physical amount for every predetermined period of time; and first storage device for storing a rotating speed change characteristic of the motor determined to adjust the physical amount with respect to respective change states of a change rate of the physical amount. Such drive control apparatus further includes calculation device for calculating the change rate of the physical amount detected by the detection means; selecting a rotating speed change characteristic corresponding to a change state of the calculated change rate to read thereof from the first storage means; and outputting a first indication signal indicating a rotating speed of the motor on the basis of the read rotating speed change characteristic. The drive control apparatus of the fifth aspect of this invention further includes. motor rotation control device for controlling rotation of the motor on the basis of the first indication signal output from the calculation device.

According to the sixth aspect of the present invention, there is provided a drive control apparatus for a motor according to the fifth aspect. Such drive control apparatus includes second storage device for storing a predetermined threshold value of the physical amount, the physical amount detected by the detection means, the change rate calculated by the calculation means, and the rotating speed of the motor indicated by the first indication signal. The calculation device is for reading the threshold value stored in the second storage device, the physical amount previously obtained at the predetermined period of time, the change rate, and the rotating speed of the motor. The change rate is newly calculated based on the physical amount newly detected by the detection device and the read physical amount previously obtained at the predetermined period of time. A difference between the newly calculated change rate and the read change rate previously obtained at the predetermined period of time is calculated. Further a difference between the newly detected physical amount and the read threshold value is also calculated. The rotating speed change characteristic is selected based on the calculated change rate, the difference between the change rates, and the difference between the newly detected physical amount and the read threshold value to read thereof from the first storage device. The new first indication signal is outputted as a new rotating speed of the motor obtained by adding a change amount of the rotating speed of the motor based on the read rotating speed change characteristic to the rotating speed of the motor previously obtained at the predetermined period of time.

According to the seventh aspect of the present invention, there is provided a drive control apparatus for a motor according to the fifth or sixth aspect. In such a drive control apparatus, the calculation device has a function of outputting, to the detection device, a second indication signal for setting the predetermined period of time to be a short period of time when the change rate sharply changes. Such calculation device further sets the predetermined period of time to be a long period of time when the change rate moderately changes. The detection device detects the physical amount of time based on the second indication signal output from the calculation means.

According to the eighth aspect of the present invention, there is provided a drive control apparatus for a motor according to any one of the fifth to seventh aspects. In such a drive control apparatus, when the physical amount newly detected by the detection device is smaller than the threshold value, the calculation device reads the physical amount previously obtained at the predetermined period of time and stored in the second storage means, newly calculates the change rate on the basis of the newly detected physical amount and the read physical amount, and reads the rotating speed of the motor previously obtained at the predetermined period of time before and stored in the second storage means. Furthermore, when the read rotating speed of the motor is larger than a predetermined lower limit value, the calculation device outputs the new first indication signal as a new rotating speed of the motor obtained by adding a change amount of a predetermined negative rotating speed for reducing the rotating speed of the motor to the read rotating speed of the motor.

According to the ninth aspect of the present invention, there is provided a drive control apparatus for a motor according to any one of the fifth to eighth aspects. In such a drive control apparatus, the adjusting device is a cooling fan having a fan rotated by the motor, and the physical amount is a temperature of a heat-generating member cooled by the cooling fan.

These and other features of the invention will be understood upon reading of the following description along with the drawings.

DETAILED DESCRIPTION OF THE PREFERRED EMBODIMENTS

Figure 1:
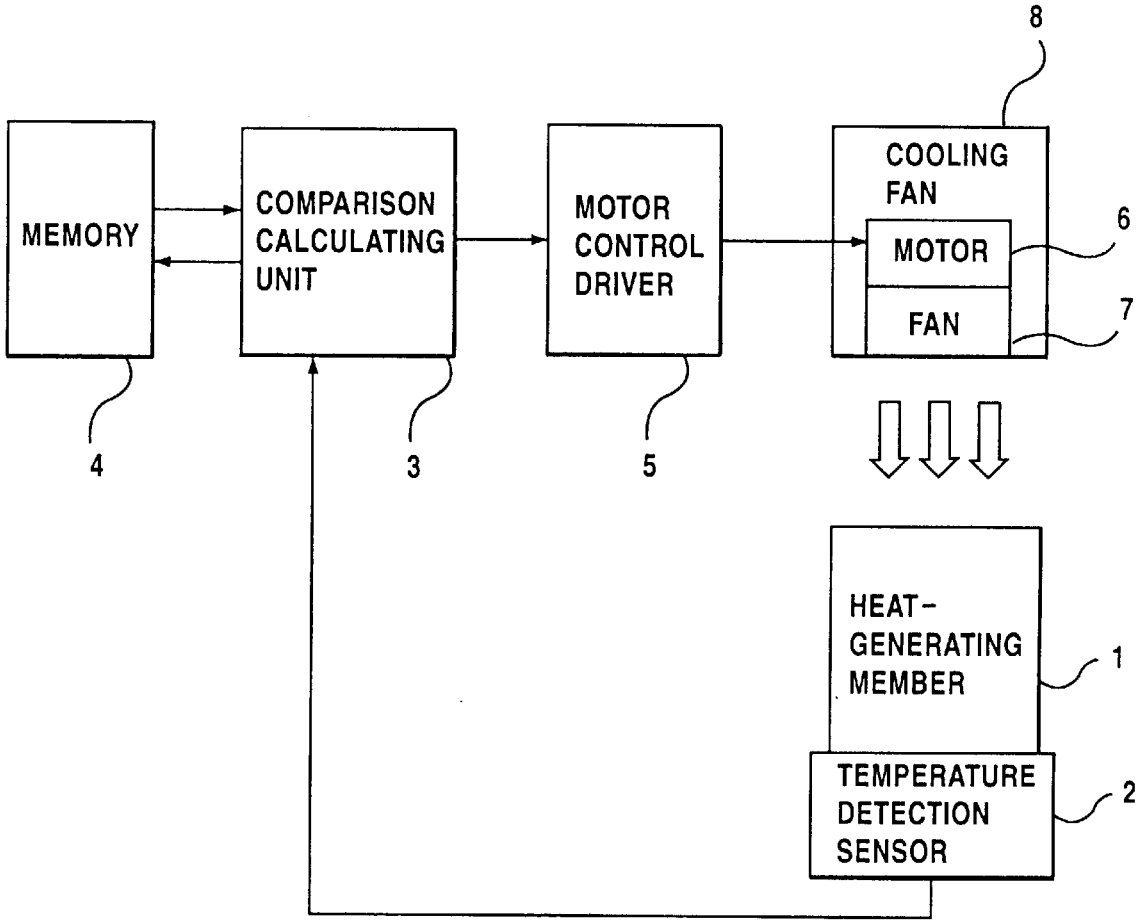
FIG. 1 is a block diagram showing a structural arrangement of a motor drive control apparatus according to the first embodiment of the present invention.

The first embodiment of the present invention will be described below with reference to the accompanying drawings. FIG. 1 is a block diagram showing the structural arrangement of a motor drive control apparatus according to the first embodiment of the present invention.

In reference to FIG. 1, reference numeral 1 denotes a heat-generating member which must be cooled when its temperature becomes a predetermined temperature or more, and corresponds to, e.g., a CPU or the like in a calculation process. Reference numeral 2 denotes a temperature detection sensor for detecting the temperature of the heat-generating member 1 at every predetermined period of time $\Delta t$ (e.g., 1 second, 2 seconds or the like).

Reference numeral 3 denotes a comparison calculating unit for recognizing a temperature change state of the heat-generating member 1 on the basis of the temperature (hereinafter referred to as a "temperature detection value") of the heat-generating member 1 detected by the temperature detection sensor 2 and data stored in a memory 4 in order to output a signal indicating the rotating speed of a motor 6 to a motor control driver 5. The comparison calculating unit 3 outputs, to the memory 4, data (i.e., the temperature detection value, a temperature change amount per unit time, and the rotating speed of the motor 6 indicated to the motor control driver 5), and the memory 4 stores such data. An operation of the comparison calculating unit 3 will be described later.

The motor control driver 5 controls a rotating speed control parameter supplied to the motor 6 (e.g., a current value, a voltage value or a frequency, or the like) on the basis of the indication data of the rotating speed of the motor 6 outputted from the comparison calculating unit 3 to control a drive of the motor 6. The motor 6 rotates a fan 7. The motor 6 and the fan 7 constitute a cooling fan 8.

An operation of the motor drive control apparatus according to this embodiment will be described below in reference to the flow chart shown in FIG. 2.

In step S1, the temperature of the heat-generating member 1 at time $t_n$ is detected by the temperature detection sensor 2, and the temperature is inputted to the comparison calculating unit 3 as a temperature detection value $T_n$. In this case, the temperature detection is performed every predetermined period of time $\Delta_t$ after the operation of the entire apparatus is started, and temperature detection values are represented by subscripted symbols $T_1$, $T_2$, . . . $T_n$ in a detection order.

In step S2, the comparison calculating unit 3 compares the temperature detection value $T_n$ with a limit value A. In this case, the limit value A is a temperature value (threshold value) serving as a reference for determining whether the heat-generating member 1 requires cooling. The limit value A is a boundary temperature which is set in the following manner. When the temperature of the heat-generating member 1 is equal to or lower then A, the fan 7 is stopped or rotated at a predetermined low speed R; and when the temperature is higher than A, the fan 7 is rotated by a drive control for the motor 6 to be described later.

At this time, when the temperature detection value $T_n$ is higher than the limit value A, the result of comparison calculation in step S2 becomes "Yes", and the flow shifts to step S3. The rotating speed of the motor 6 is determined by a calculating process in the comparison calculating unit 3 to be described later, and the operation of the cooling fan 8 is controlled on the basis of the rotating speed.

In step S3, a previous temperature detection value $T_{n-1}$ and a temperature change rate $K_{n-1}$ are loaded from the memory 4. The temperature change rate $K_{n-1}$ is a temperature change rate which is calculated by the comparison calculating unit 3 in the previous (a period of time $\Delta t$ before) temperature detection and stored in the memory 4. A temperature change rate $K_n$ is calculated in step S4; a difference $\Delta k_n$ between the previous temperature change rate $K_{n-1}$ and the temperature change rate $K_n$ is calculated in step S5; and a temperature difference $K'_n$ between the limit value A and the temperature detection value $T_n$ is calculated in step S6. The flow then shifts to step S7.

Since there is no temperature detection value $T_0$ at time $t_{n-1}$ with respect to a temperature change rate $K_1$ obtained when the operation of the entire apparatus is started to perform the first temperature detection, the temperature detection value $T_0$ is set to 0 or a proper value in advance in order to calculate the temperature change rate $K_1$. On the other hand, when the temperature change rate $K_1$ is not calculated, a temperature change rate in the second or subsequent temperature detection may be calculated first.

Figure 3:
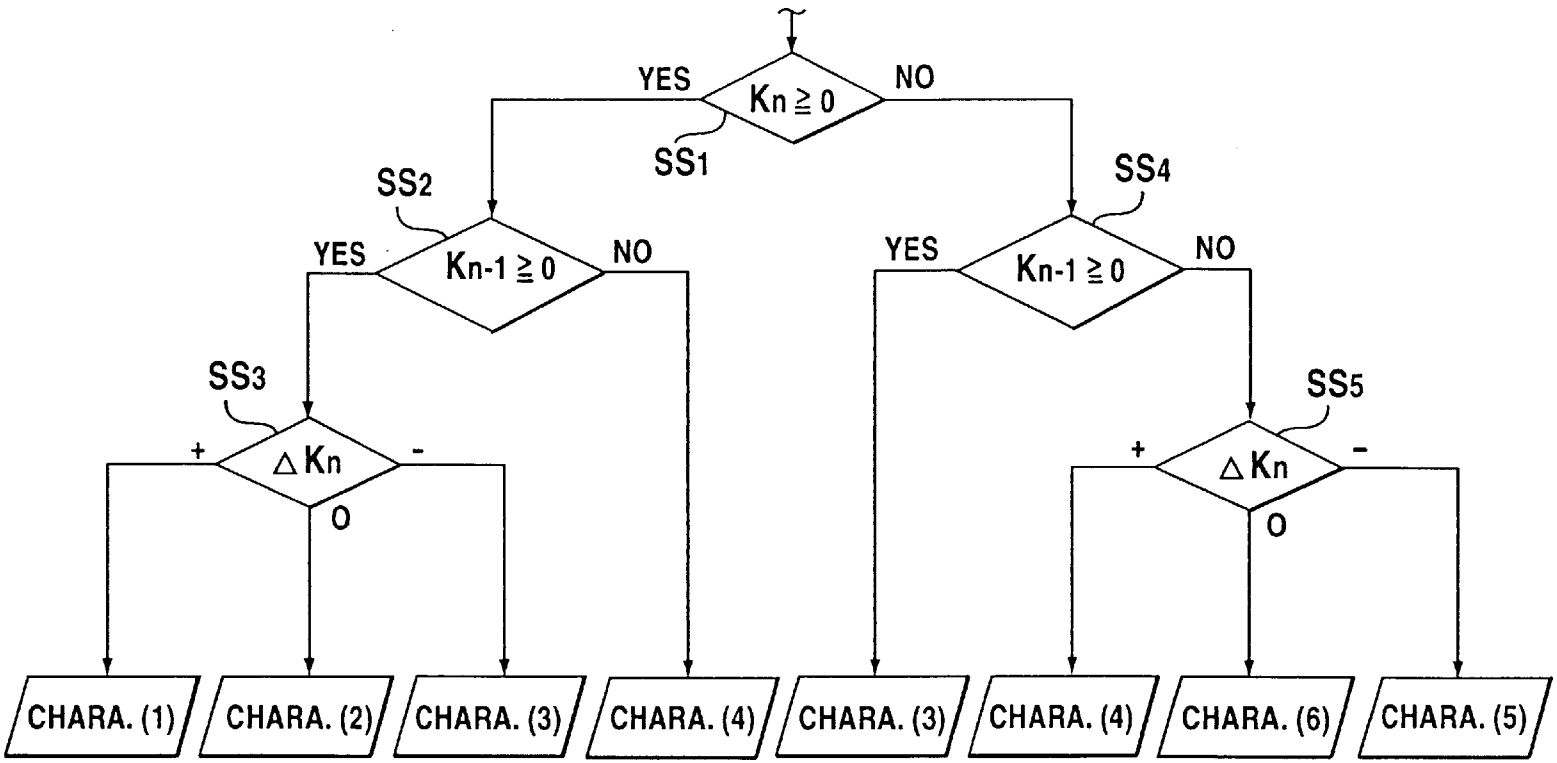
FIG. 3 is a flow chart showing the process of selecting a rotating speed change characteristic in step S7 in FIG. 2.
Figure 4:
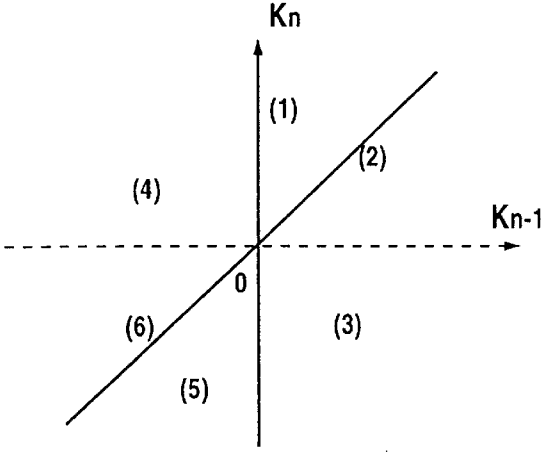
FIG. 4 is a graph showing the first example of divided regions serving as a reference for selecting a rotating speed change characteristic in step S7 in FIG. 1.

In step S7, according to a flow chart shown in FIG. 3, depending on a region, on a $K_{n-1}$–$K_n$ plane in FIG. 4, to which the temperature change rates $K_n$ and $K_{n-1}$ and the difference $\Delta k_n$ obtained at this time belong, a rotating speed change characteristic for determining a change amount $\Delta r$ of the rotating speed of the motor is selected. The rotating speed change characteristic described here is the change amount $\Delta r$ with respect to the temperature change rates $K_n$ and $K_{n-1}$, the difference $\Delta k_n$, and the difference $K'_n$ which represent the temperature change state of the heat-generating member 1.

The above-discussed rotating speed change characteristic is set in advance such that an appropriate cooling operation is performed according to the temperature of the heat-generating member 1, the performance of the motor 6, or the like. In this embodiment, as the rotating speed change characteristics, characteristics 1 to 6 expressed by straight lines having predetermined inclinations shown in FIGS. 5 to 10 are, for example, used. These straight lines, as shown in FIGS. 5 to 10, are constituted by straight lines respectively corresponding to cases wherein the value $K'_n$ corresponds to values . . . $<a_i<a_j<a_k<a_l<$ . . . . When data related to the rotating speed change characteristics are stored in the memory 4 or stored in a ROM (Read-Only Memory) arranged in the comparison calculating unit 3, these data can be properly referred to.

The process of selecting the rotating speed change characteristic in step S7 in FIG. 2 will be described below with reference to the flow chart in FIG. 3, a $K_{n-1}$–$K_n$ plane in FIG. 4, and a graph showing the temperature change of the heat-generating member 1 in FIG. 11. The flow chart in FIG. 3 shows the process of determining the polarities or the like of the temperature change rates $K_n$ and $K_{n-1}$ and the difference $\Delta k_n$ in this order to select characteristic.

Figure 11:
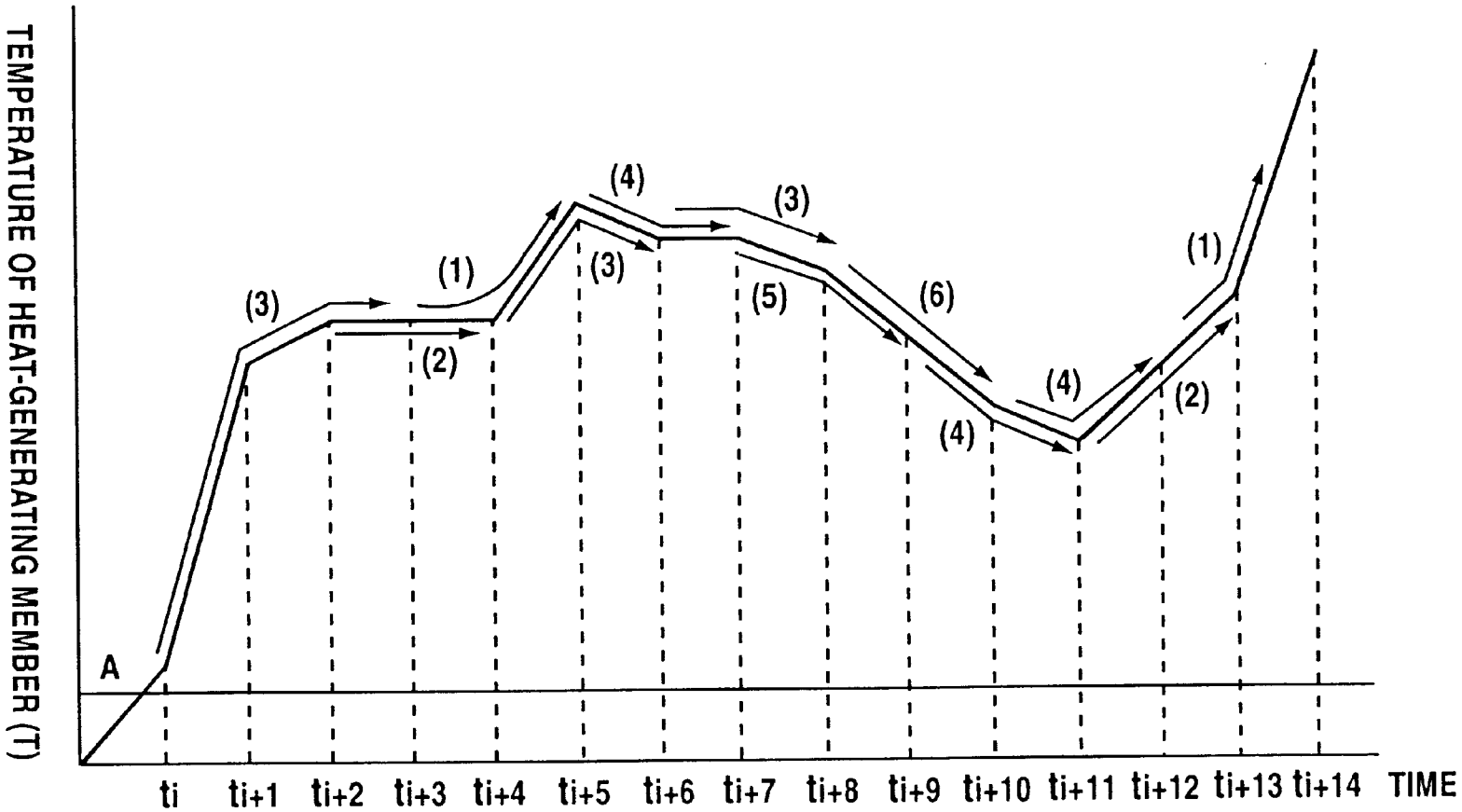
FIG. 11 is a graph showing a change in temperature of the heat-generating member 1 with time.

As in a temperature change process represented by 1 in times $t_{i+12}$–$t_{i+14}$ in FIG. 11, assume that the temperature detection value continuously increases, and that the degree of the increase in temperature detection value increases. At this time, the temperature change rates $K_n$ and $K_{n-1}$ are positive values, and the difference $\Delta K_n$ is a positive value. Therefore, when a determination result obtained by checking whether $K_n \geqq 0$ is satisfied in step SS1 in FIG. 3 is "Yes", the flow shifts to step SS2. When a determination result obtained by checking whether $K_{n-1} \geqq 0$ is satisfied in step SS2 is "Yes", the flow shifts to step SS3. A characteristic 1 is selected by determination with respect to the value $\Delta K_n$. In this case, the temperature change rates $K_n$ and $K_{n-1}$ and the difference $\Delta k_n$ belong to a region 1 in FIG. 4.

Figure 5:
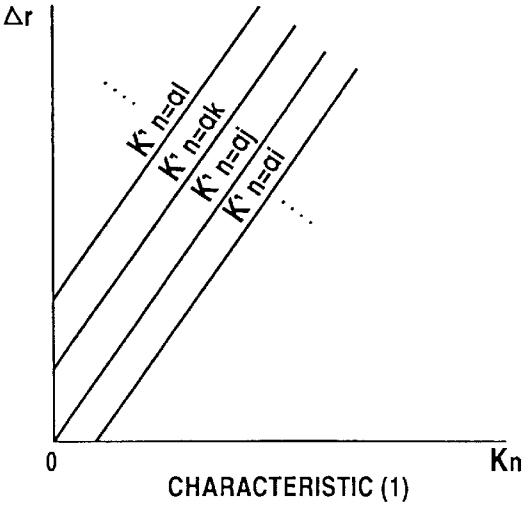
FIG. 5 is a graph showing the correspondence between a temperature change rate $K_n$ and a motor rotating speed change amount $\Delta r$ in a characteristic 1.

The characteristic 1 selected as described above is set to be a straight line having a large inclination as shown in FIG. 5 in order to cope with a case wherein the temperature of the heat-generating member 1 continuously increases as described above and the degree of the increase in temperature increases. A change amount $\Delta r$ of the rotating speed of the motor corresponding to the characteristic 1 is set to be increased.

As in a temperature change process represented by 2 in times $t_{i+11}$–$t_{i+13}$ in FIG. 11, assume that the temperature detection value continuously increases, and that the degree of the increase in temperature detection value is kept constant; and as in a temperature change process represented by 2 in times $t_{i+2}$–$t_{i+4}$ in FIG. 11, assume that the temperature detection value does not change and does not increase, the temperature change rates $K_n$ and $K_{n-1}$ are positive values or 0, and the difference $\Delta k_n$ is 0. Therefore, in this case, the same process as the temperature change process represented by 1 is performed up to steps SS1, SS2, and SS3; a characteristic 2 is selected by determination performed in step SS3. In this case, the temperature change rates $k_n$ and $K_{n-1}$ and the difference $\Delta k_n$ belong to a region 2 on a straight line ($K_n=K_{n-1}$) including the origin and extending from the origin to the first quadrant in FIG. 4.

As in a temperature change process represented by 3 in times $t_i$–$t_{i+3}$ in FIG. 11, assume that the temperature detection value continuously increases, and that the degree of the increase in temperature detection value decreases. In this case, the same process as the temperature change process represented by 1 is performed up to steps SST, SS2, and SS3, a characteristic 3 is selected because $\Delta K<0$ is satisfied in step SS3. In this case, the temperature change rates $K_n$ and $K_{n-1}$ and the difference $\Delta K_n$ belong to a region 3 in FIG. 4.

Figure 6:
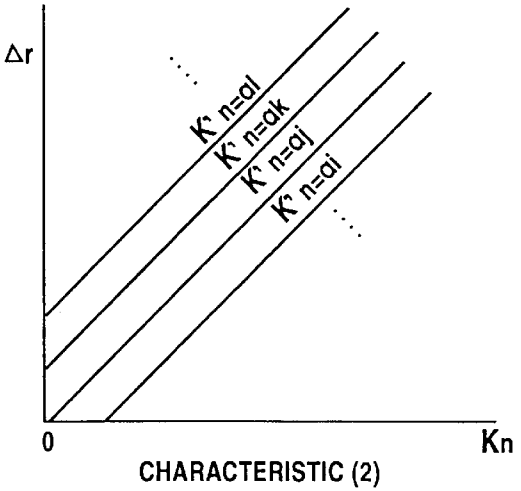
FIG. 6 is a graph showing the correspondence between a temperature change rate $K_n$ and a motor rotating speed change amount $\Delta r$ in a characteristic 2.
Figure 7:
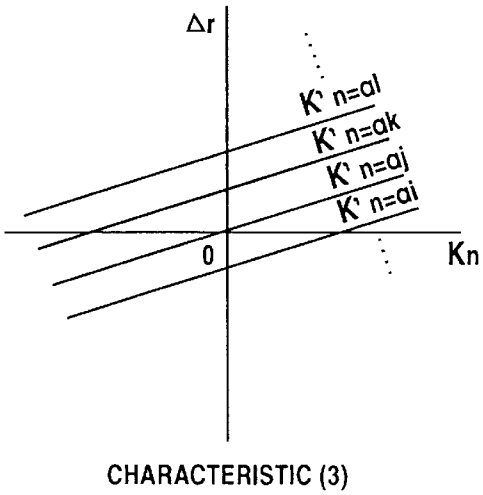
FIG. 7 is a graph showing the correspondence between a temperature change rate $K_n$ and a motor rotating speed change amount $\Delta r$ in a characteristic 3.

In the temperature change processes represented by 2 and 3 in FIG. 11, although the temperature of the heat-generating member 1 does not change or continuously increases, the increase in temperature is not sharper than that in a case wherein the characteristic 1 in FIG. 11 is selected. Therefore, as shown in FIGS. 6 and 7, the inclinations of the straight lines of the characteristics 2 and 3 are set to be smaller than the inclination of the straight line of the characteristic 1, and the change amount $\Delta r$ of the motor rotating speeds corresponding to the characteristics 2 and 3 are smaller than that corresponding to the characteristic 1.

On the other hand, as in a temperature change process represented by 4 in times $t_{i+10}$–$t_{i+12}$ in FIG. 11, assume that the temperature detection value temporarily decreases and then increases. At this time, the temperature change rate $K_n$ is a positive value, and the temperature change rate $K_{n-1}$ is a negative value. Therefore, when the determination result in step SS1 in FIG. 3 is "Yes", the flow shifts to step SS2. When the determination result in step SS2 is "No", a characteristic 4 is selected. As in the temperature change process represented by 4 in times $t_{i+5}$–$t_{i+7}$, when the temperature detection value temporarily decreases and then is kept constant ($K_n=0$), the characteristic 4 is selected in the same manner as described above. In this case, the temperature change rates $K_n$ and $K_{n-1}$ and the difference $\Delta k_n$ belong to a region 4 in FIG. 4.

Figure 8:
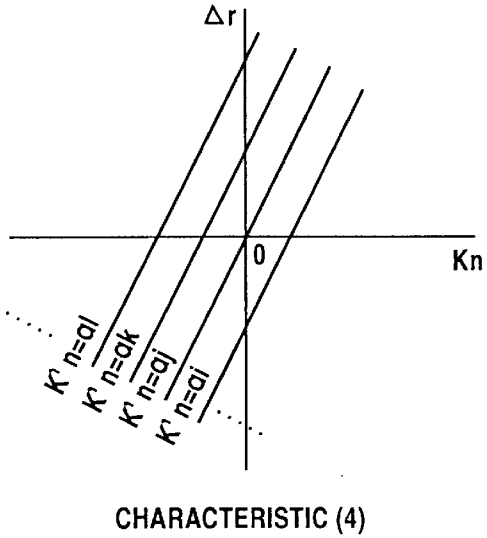
FIG. 8 is a graph showing the correspondence between a temperature change rate $k_n$ and a motor rotating speed change amount $\Delta r$ in a characteristic 4.

In the temperature change described above, a strong cooling operation must be performed. For this reason, as shown in FIG. 8, the characteristic 4 is set to be a straight line having a considerably large inclination, and the change amount $\Delta r$ of the motor rotating speed corresponding to the characteristic 4 is set to be considerably increased.

As in a temperature change process represented by 3 in times $t_{i+4}$–$t_{i+6}$ in FIG. 11, assume that the temperature detection value increases and then decreases; and as in a temperature change process represented by 3 in times $t_{i+5}$–$t_{i+6}$ in FIG. 11, assume that the temperature detection value does not change and then decreases, the temperature change rate $K_n$ is a negative value, and the temperature change rate $K_{n-1}$ is a positive value or 0. Therefore, when the determination result in step SS1 in FIG. 3 is "No", the flow shifts to step SS4. When the determination result in step SS4 is "Yes", a characteristic 3 in FIG. 7 is selected. In this case, the characteristic 3 having a positive inclination is selected in consideration of the following facts. That is, although the temperature of the heat-generating member 1 begins to decrease, the temperature had increased or had been kept constant.

As in a temperature change process represented by 4 in times $t_{i+9}$–$t_{i+11}$ in FIG. 11, assume that the temperature detection value continuously decreases, and that the degree of the decrease in temperature detection value decreases. At this time, the temperature change rates $K_n$ and $K_{n-1}$ are negative values, and the difference $\Delta k_n$ is a positive value. Therefore, when the determination result in step SS1 in FIG. 3 is "No", the flow shifts to step SS4. When the determination result in step SS4 is "No", the flow shifts to step SS5, and the characteristic 4 is selected by a determination with respect to the difference $\Delta k_n$ in step SS5.

In this case, although the temperature of the heat-generating member 1 decreases, the degree of the decrease in temperature decreases, the characteristic 4 expressed by a straight line having a considerably large inclination is selected in order to prevent the temperature of the heat-generating member 1 from increasing again.

On the other hand, as in a temperature change process represented by 6 in times $t_{i+8}$–$t_{i+10}$ in FIG. 11, assume that the temperature detection value continuously decreases, and that the degree of the decrease in temperature detection value is constant. In such a case, the temperature change rates $K_n$ and $K_{n-1}$ are negative values, and the difference $\Delta k_n$ is 0. Therefore, when the determination result in step SS1 in FIG. 3 is "No", the flow shifts to step SS4. When the determination result in step SS4 is "No", the flow shifts to step SS5, and a characteristic 6 is selected by determination in step SS5. In such a case, the temperature change rates $K_n$ and $K_{n-1}$ and the difference $\Delta k_n$ belong to a region 6 on a straight line ($K_n=K_{n-1}$) extending from the origin to the third quadrant in FIG. 4. It is noted that the region 6 does not include the origin in FIG. 4.

As in a temperature change process represented by 5 in times $t_{i+7}$–$t_{i+9}$in FIG. 11, assume that the temperature detection value continuously decreases, and that the degree of the decrease in temperature detection value increases. In such a case, the same process as the temperature change process represented by 6 is performed up to steps SS1, SS2, and SS3, a characteristic 5 is selected because $\Delta K<0$ is satisfied in step SS5. In this case, the temperature change rates $K_n$ and $K_{n-1}$ and the difference $\Delta k_n$ belong to a region 5 in FIG. 4.

Figure 9:
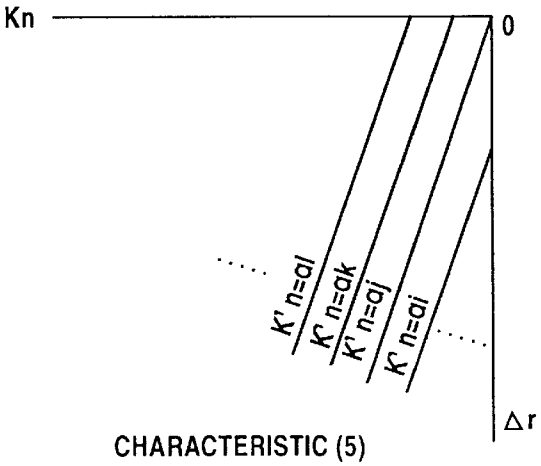
FIG. 9 is a graph showing the correspondence between a temperature change rate $K_n$ and a motor rotating speed change amount $\Delta r$ in a characteristic 5.
Figure 10:
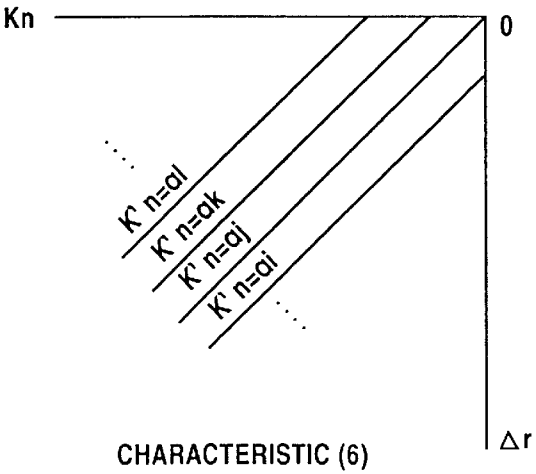
FIG. 10 is a graph showing the correspondence between a temperature change rate $K_n$ and a motor rotating speed change amount $\Delta r$ in a characteristic 6.

Each of these temperature change processes represented by 5 and 6 means a situation whereby the temperature of the heat-generating member 1 continuously decreases, and the cooling operation is satisfactorily performed. Therefore, in order to suppress an excessive cooling operation, as shown in FIGS. 9 and 10, the characteristics 5 and 6 are expressed by straight lines each having a positive inclination. The amount in the changes in the motor rotating speeds $\Delta r$ corresponding to the characteristics 5 and 6 are set to negative values.

Figure 2:
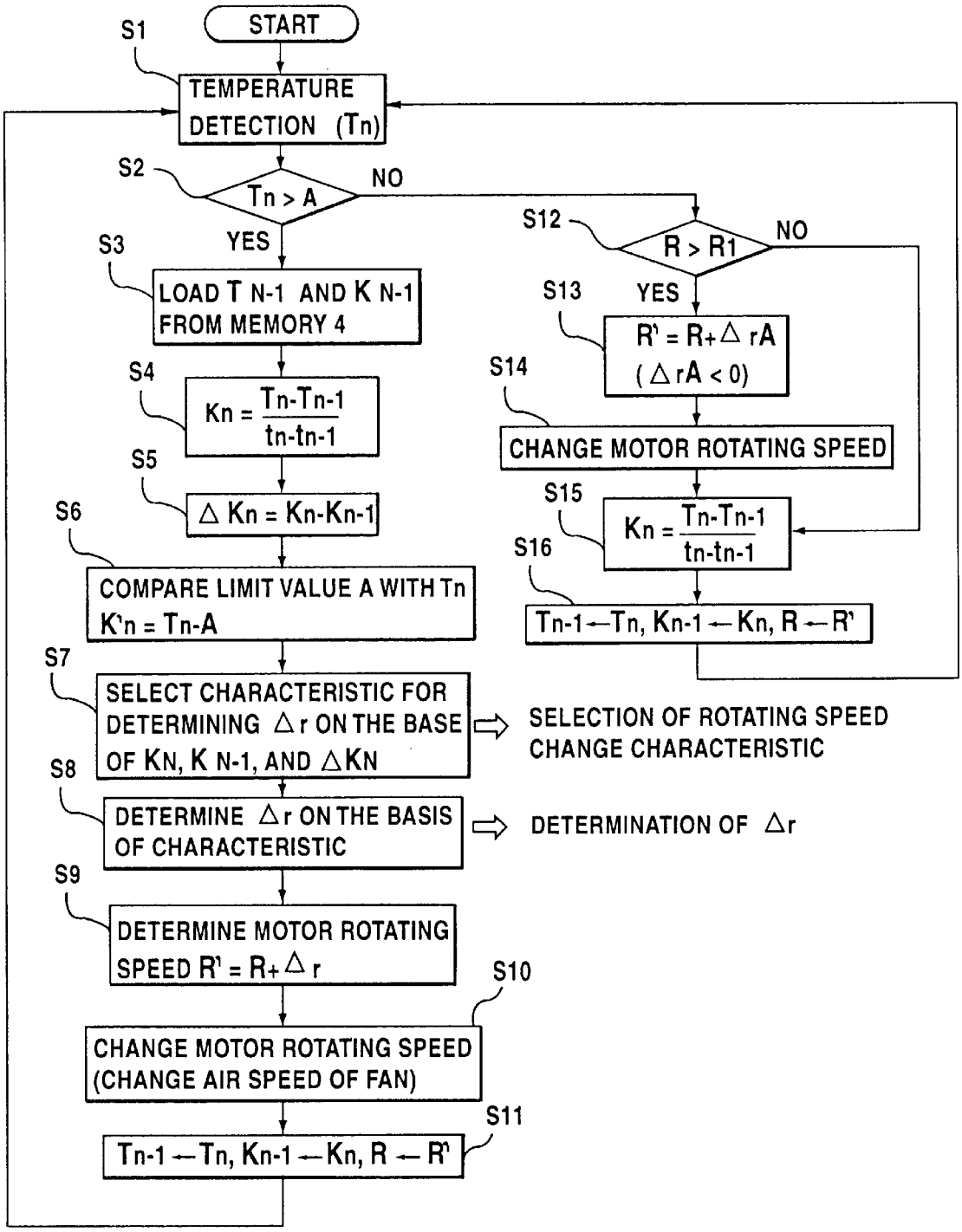
FIG. 2 is a flow chart showing an operation of the motor drive control apparatus shown in FIG. 1.

When the process of selecting a rotating speed change characteristic in step S7 in FIG. 2 is performed, in step S8, an amount in a change of a motor rotating speed $\Delta r$, based on the temperature change rate $K_n$ and the temperature difference $K'_n$ depending on the selected characteristic, is determined (see FIGS. 5 to 10).

A motor rotating speed R before the change in motor rotating speed is read from the memory 4 in step S9. The motor rotating speed R is added to the amount in the change in the motor rotating speed $\Delta r$ determined as described above. The resultant value is used as a motor rotating speed R' after the change in the motor rotating speed.

Subsequently, in step S10, the comparison calculating unit 3 outputs the motor rotating speed R' after the change in the motor rotating speed to the motor control driver 5 as data indicating the rotating speed of the motor 6. In this manner, the motor control driver 5 controls, on the basis of the data, parameters (e.g., a current value, a voltage value or a frequency or the like) for controlling the rotating speed supplied to the motor 6 to control the motor 6. The rotation of the fan 7 is adjusted, and an operation of the cooling fan 8 corresponding to a change in temperature detection value $T_n$ is performed.

In step S11, the temperature detection value $T_n$, the temperature change rate $K_n$, and the motor rotating speed R' after the change in motor rotating speed are outputted from the comparison calculating unit 3, data (such as, the temperature detection value $T_{n-1}$, the temperature change rate $K_{n-1}$, and the motor rotating speed R) stored in the memory 4 are updated. Thereafter, the flow returns to step S1.

A case wherein the temperature detection value $T_n$ is smaller than the limit value A in step S2 will be described below. In this case, the comparison calculating unit 3 determines that the heat-generating member 1 need not be cooled, the result of the comparison calculation in step S2 is "no", and the flow shifts to step S12. The comparison calculating unit 3 reads the motor rotating speed R at this time from the memory 4, and compares the motor rotating speed R with a motor rotating speed R1 ($\geqq 0$) preset as the lower limit value of the rotating speed. It is noted that the motor rotating speed R1 is desirably set to satisfy R1>0 in order to avoid the motor from being frequently rotated/stopped.

In this case, when the motor rotating speed R is equal to the motor rotating speed R1, the result of comparison calculation in step S12 is "no", the flow jumps steps S13 and S14 to shift to step S15. On the other hand, when the motor rotating speed R is higher than-the motor rotating speed R1, the result of comparison -calculation in step S12 is "yes", and the flow shifts to step S13.

In step S13, a value obtained by adding the preset amount in the change of the motor rotating speed $\Delta r$ to the motor rotating speed R is used as the motor rotating speed R'. In this case, a motor rotating speed change amount $\Delta r_A$ is set to a predetermined negative value which gradually decreases the motor rotating speed R. In step S14, the comparison calculating unit 3 outputs the motor rotating speed R' to the motor control driver 5 as data indicating the rotating speed of the motor 6, thereby controlling drive of the motor 6.

In this manner, the rotation of the motor 6 is prevented from being suddenly decelerated or stopped. When the heat-generating member 1 need not be cooled, the rotation of the motor 6 is gradually decelerated.

The temperature change rate $K_n$ is calculated in step S15. In step S16, the temperature detection value $T_n$, the temperature change rate $K_n$, and the motor rotating speed R' after the change in motor rotating speed are outputted from the comparison calculating unit 3, and the data (i.e., the temperature detection value $T_{n-1}$, the temperature change rate $K_{n-1}$, and the motor rotating speed R) in the memory 4 are updated. Thereafter, the flow returns to step S1.

Subsequently, the above operation is repeated in the same manner as described above, thereby controlling drive of the motor 6. An operation of the cooling fan 8 corresponding to the temperature change state of the heat-generating member 1 is performed. Therefore, the motor 6 is avoided from being frequently driven or stopped, a load on the bearing of the motor 6 can be reduced, and the operation of the cooling fan 8 can be performed in accordance with the temperature change state of the heat-generating member 1.

It is noted that the motor rotating speed R at the start of the system satisfies the condition: $R \geqq R1 \geqq 0$.

In the first embodiment as described above, the process of selecting a rotating speed change characteristic in step S7 in FIG. 2 is described with reference to the flow chart in FIG. 3 and the $K_{n-1}$–$K_n$ plane in FIG. 4. However, the process of selecting a rotating speed change characteristic according to the present invention is not limited to the process described in this embodiment. The process of selecting a rotating speed change characteristic in step S7 according to another embodiment will be described below with reference to an example.

Figure 12:
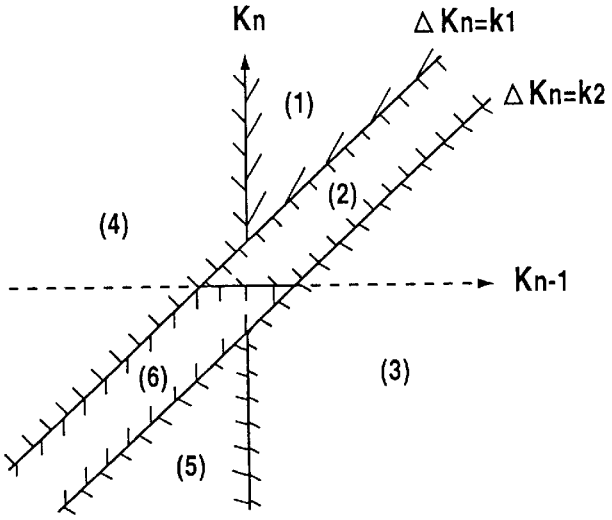
FIG. 12 is a graph showing the second example of divided regions serving as a reference for selecting a rotating speed change characteristic in step S7 in FIG. 2.

FIG. 12 shows a $K_{n-1}$–$K_n$ plane divided into six regions 1 to 6. The divided regions are obtained in such a manner that a predetermined width is given to the straight line $K_n=K_{n-1}$ serving as the regions 2 and 6 in FIG. 4. The regions 2 and 6 in FIG. 4 are regions corresponding to a case wherein the temperature change rates $K_n$ and $K_{n-1}$ are equal to each other (i.e., a case which is very rare when considering the change in temperature of the heat-generating member 1). On the other hand, according to the divided regions in FIG. 12, even if the temperature change rates $K_n$ and $K_{n-1}$ are not equal to each other, when the difference $\Delta K_n$ is set within a predetermined range ($k_2 \leqq \Delta k_n \leqq k_1$), and the temperature change rates $K_n$ and $K_{n-1}$ are almost equal to each other, a rotating speed change characteristic (characteristic 2 or characteristic 6), appropriate for a case wherein the temperature change rate $K_n$ is at a constant value, is selected.

Figure 13:
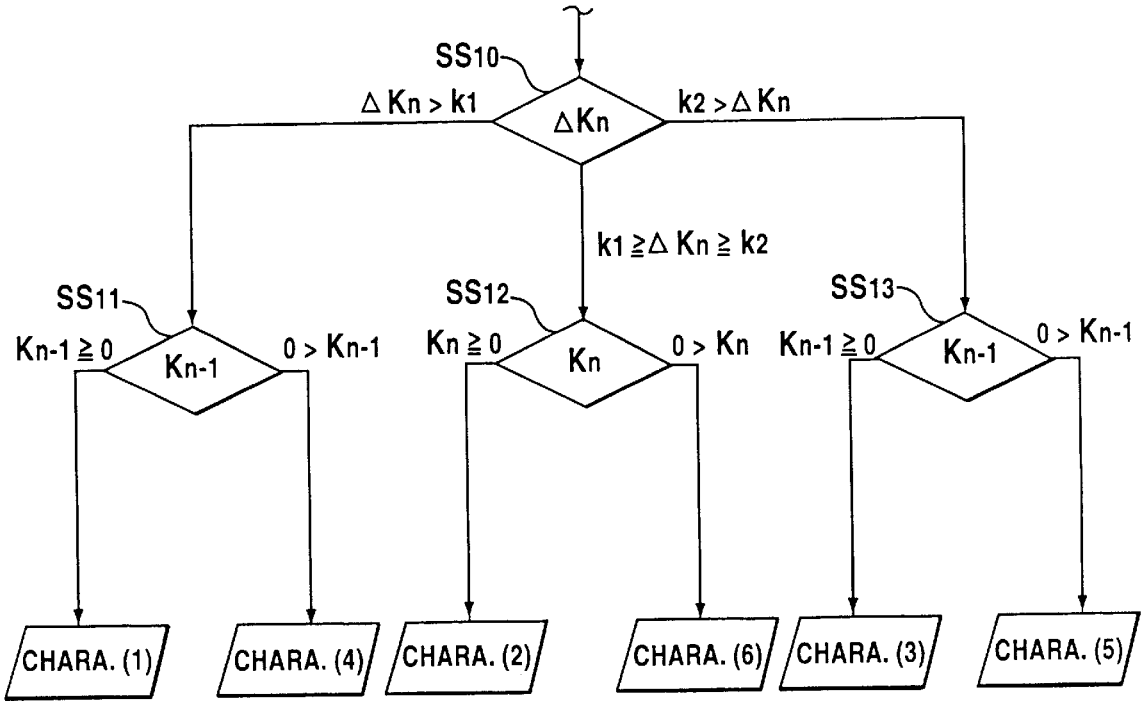
FIG. 13 is a flow chart showing the first example of the process of selecting a rotating speed change characteristic in step S7 in FIG. 2 according to the divided regions in FIG. 12.

The process of selecting a rotating speed change characteristic based on the divided regions in FIG. 12 is performed by comparison-calculation of the comparison calculating unit 3 shown in the flow chart in FIG. 13. In step SS10, determination with respect to the difference $\Delta k_n$ is performed first. When, as the determination result, the difference $\Delta k_n$ is larger than the constant value $k_1$ (i.e., when the degree of the change in temperature detection value exceeds a predetermined reference), the flow shifts to step SS11. When the temperature change rate $K_{n-1}$ is a positive value or 0 (tends to increase in the previous temperature detection), a characteristic 1 is selected; and when the temperature change rate $K_{n-1}$ is a negative value (tends to decrease in the previous temperature detection), a characteristic 4 is selected.

When the difference $\Delta k_n$ is set within the range of the constant value $k_1$ to the constant value $k_2$ ($K_2 \leqq \Delta K_n \leqq k_1$) (i.e., when the degree of the change in temperature is set within a predetermined range), the flow shifts from step SS10 to step SS12. When the temperature change rate $K_n$ is a positive value or 0 (tends to increase in the recent temperature detection), a characteristic 2 is selected. On the other hand, when the temperature change rate $K_n$ is a negative value (tends to decrease in the recent temperature detection), a characteristic 6 is selected.

When the difference $\Delta k_n$ is smaller than the constant value $k_2$ (i.e., when the degree of the change in temperature is equal to or lower than a predetermined reference), the flow shifts from step SS10 to step SS13. When the temperature change rate $K_{n-1}$ is a positive value or 0, a characteristic 3 is selected. On the other hand, when the temperature change rate $K_{n-1}$ is a negative value, the characteristic 5 is selected.

In this manner, the rotating speed change characteristic is selected on the basis of the divided regions in FIG. 12. The comparison calculation shown in the flow chart of FIG. 13 is only an example. When the rotating speed change characteristic based on the divided regions in FIG. 12 can be selected, another process of comparison calculation can be used. In this case, the flow chart of comparison calculation modified on the basis of the comparison calculation (shown in the flow chart in FIG. 3) is shown in FIG. 14.

Figures 14, 15:
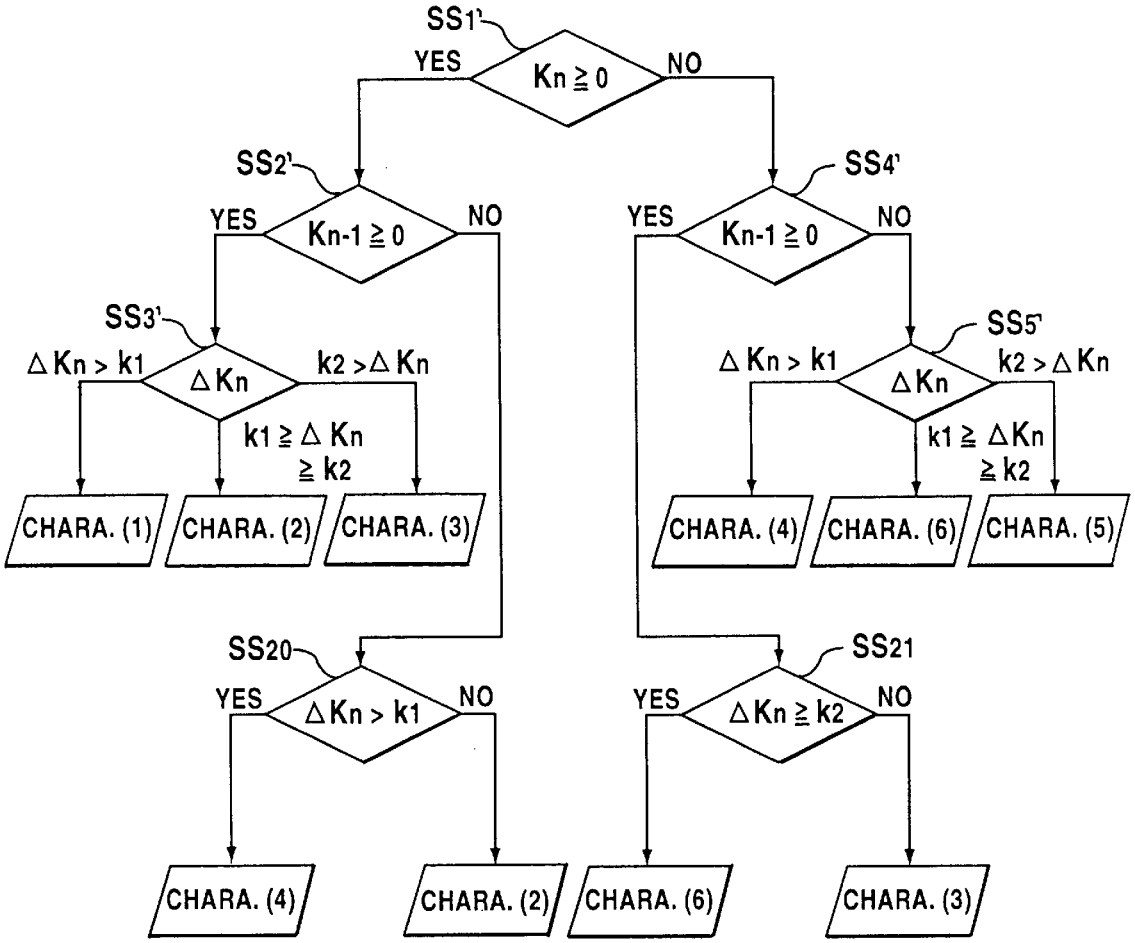
FIG. 14 is a flow chart showing the second example of the process of selecting a rotating speed change characteristic in step S7 in FIG. 2 according to the divided regions in FIG. 12.
FIG. 15 is a table showing the correspondence between the ratio $|K_n|/|K_{n-1}|$ of temperature change rates and temperature detection time.

The flow chart in FIG. 14 is the same as the flow chart in FIG. 3 (except for a comparison-calculation for the difference $\Delta k_n$). In reference to FIG. 14, the same comparison calculation for the temperature change rates $K_n$ and $K_{n-1}$ (as in steps SS1, SS2, and SS4 in FIG. 3) is performed in steps SS1', SS2', and SS4'; and a comparison-calculation for the difference $\Delta k_n$ (steps SS3', SS20, SS21, and SS5') is started.

In step SS3', a characteristic 1 is selected when the difference $\Delta k_n$ is larger than the constant value $k_1$, a characteristic 2 is selected when the difference $\Delta k_n$ is set within the range of the constant value $k_1$ to the constant value $k_2$, and a characteristic 3 is selected when the difference $\Delta k_n$ is smaller than the constant value $k_2$. The range in which the characteristic 2 is selected in step SS3 in FIG. 3 is widened. When the determination result in step SS2' is "no", and the flow shifts to step SS20, $K_n \geqq 0$ and $K_{n-1}<0$ are satisfied. For this reason, the temperature change rates $K_n$ and $K_{n-1}$ are plotted in the second quadrant in FIG. 12. Therefore, one of the characteristics 4 and 2 is selected by only comparison calculation between the difference $\Delta k_n$ and the constant value $k_1$.

On the other hand, when the determination result in step SS4' is "yes", and the flow shifts to step SS21, $K_n<0$ and $K_{n-1} \geqq 0$ are satisfied. For this reason, the temperature change rates $K_n$ and $K_{n-1}$ are plotted in the fourth quadrant in FIG. 12. Therefore, one of the characteristics 6 and 3 is selected by only comparison- calculation between the difference $\Delta k_n$ and the constant value $k_2$. In addition, when the flow shifts to step SS5', the same process as the comparison calculation in step SS3' is performed, thereby selecting one of the characteristics 4, 6, and 5.

The second embodiment of the present invention is hereinafter described. A drive control apparatus for a motor according to the second embodiment of the present invention has the following structural arrangement. That is, in the above structural arrangement of the drive control apparatus for a motor shown in the block diagram in FIG. 1, a calculation process to be described below is added to the calculation process in the comparison calculating unit 3, and a temperature detection sensor having a function of detecting the temperature of the heat-generating member 1 at a time indicated by a signal output from the comparison calculating unit 3 is used as the temperature detection sensor 2.

In the above-discussed structural arrangement, the operation in steps S1, S2, and S3 or S12 to S14 in the flow chart shown in FIG. 2 is performed in the same manner as described above, and a temperature change rate $K_n$ is calculated in step S4 or S15. Thereafter, a ratio $|K_n|/|K_{n-1}|$ of the absolute value of the temperature change rate $K_n$ and the absolute value of a previous (a prior time $\Delta t$) temperature change rate $K_{n-1}$ is calculated.

As shown in FIG. 15, when the ratio $|K_n|/|K_{n-1}|$ is larger than 1 (i.e., when the degree of the change in temperature of the heat-generating member 1 increases), the time $\Delta t$ is set to shorten a temperature detection cycle. When the ratio $|K_n|/|K_{n-1}|$ is equal to 1 (i.e., when the degree of the change in temperature of the heat-generating member 1 is constant), the time $\Delta t$ is set to a constant value in order to keep the temperature detection cycle constant. On the other hand, the ratio $|K_n|/|K_{n-1}|$ is smaller than 1 (i.e., when the degree of the change in temperature decreases), the time $\Delta t$ is set to lengthen a temperature detection cycle.

The operation in steps S5 to S11 in the flow chart in FIG. 2 is performed in the same manner as described above. A signal indicating temperature detection time based on the time $\Delta t$ set by the above process is outputted from the comparison calculating unit 3 to the temperature detection sensor 2; and the temperature detection sensor 2 detects the temperature of the heat-generating member 1 at the time indicated by the signal. When the flow shifts to step 12, the signal indicating the temperature detection time is designed to be outputted to the temperature detection sensor 2 after the operation in step S16 is performed.

Subsequently, the drive of the motor 6 is controlled on the basis of a temperature detection value at each time. Therefore, the drive of the motor 6 can be controlled at short intervals when an amount of heat from the heat-generating member 1 sharply changes, and the drive of the motor 6 can be controlled at long intervals when the heat amount moderately changes. An operation of the cooling fan 8, which is more appropriate for the temperature change state of the heat-generating member 1, can be performed.

In the above-discussed indication of temperature detection time, the time $\Delta t$ is set to a constant value only when the ratio $|K_n|/|K_{n-1}|$ is equal to 1. However, when the ratio $K_n|/|K_{n-1}|$ is set within a certain range close to 1, the time $\Delta t$ may be set to a constant value. In addition, the index used when the above indication of temperature detection time is not limited to the ratio $|K_n|/|K_{n-1}|$, the difference $\Delta k_n$, the temperature difference $K'_n$ or the like may be used.

In order to confirm whether the cooling fan 8 exhibits desired cooling performance by the drive control for the motor 6 performed by the motor drive control apparatus described above, the rotating state of the motor 6 or the fan 7 may be monitored. This can be achieved by arranging a rotation detection unit for detecting the rotating state.

FOR EXAMPLE (a) A measurement device for measuring the current value, voltage value or the like of the motor 6 is arranged, and the rotating state of the motor 6 is monitored by the measurement value from the measurement device.

(b) A light-reflecting member is attached to one blade of the fan 7, a photosensor for detecting light reflected from the reflecting member is arranged, and the rotating state of the fan 7 is monitored by a signal obtained by the reflected light detected by the photosensor.

(c) A Hall element for detecting movement of a magnet in the motor 6 is arranged, and the rotating state of the motor 6 is monitored by the detection result from the Hall element.

(d) An air-speed sensor, a pressure sensor or the like for detecting a blowing state set by the fan 7 are arranged, and the rotating state of the fan 7 is monitored by the detection result from the sensors. In this manner, when it is detected that the motor 6 or the fan 7 is in an undesirable rotating state, the entire apparatus is reset, or abnormality is displayed to cope with such an undesirable state.

In the embodiment of the present invention, drive of the motor of the cooling fan for cooling the heat-generating member is controlled. However, the same motor drive control apparatus, as described above, may be used in motors used in various pumps. For example, when a pump for pumping water into a predetermined vessel is used, a sensor for detecting a water level in the vessel every predetermined period of time, the motor of the pump is controlled by motor drive control of the same type as described above on the basis of the detection result of the water level obtained by the sensor and the change rate of the water level. In this manner, water can be supplied according to the change in water level in the vessel.

The flow rates of predetermined gas, liquid or the like supplied by the pump may be adjusted by controlling drive of the motor on the basis of the change in temperature of the heat-generating member 1 according to the above embodiment. When a gas, liquid or the like used for cooling the heat-generating member 1 is used as the above predetermined gas, liquid or the like, the heat-generating member 1 can be cooled by a method other than the method in which blowing is obtained by the rotation of the fan.

In a motor used in a hand or the like of a robot for holding an object, a sensor for detecting a pressure on a surface with which the object to be held and the hand or the like are in contact every predetermined period of time is arranged; and the same motor drive control as described above is performed on the basis of the magnitude of the detected pressure and a change rate thereof. In this manner, the gripping force of the hand or the like may be adjusted.

As described above, according to the present invention, the drive of the motor is controlled according to the change state of a predetermined physical amount (such as, the temperature or the like of the heat-generating member) such that the motor is rotated at a high or low speed. In this manner, a load on the bearing of the motor is considerably reduced in comparison with a case wherein the motor is continuously rotated or drive/stop of the motor is frequently repeated. For this reason, the service life of the motor can be prolonged. In addition, according to the present invention, when drive of the motor is controlled in accordance with the change state of the physical amount, the physical amount is adjusted to be in a desired state. Therefore, adjustment which is more appropriate for the change state of the target physical amount can be advantageously performed.

According to the second aspect of the present invention, since the change state is recognized on the basis of various viewpoints (such as, the value of the physical amount, a change rate thereof or the like) obtained at a given time and at a predetermined period of time after such given time, a more appropriate rotating speed change characteristic can be selected with respect to the change states at the respective times.

The drive control apparatus for a motor according to the fifth or sixth aspect in which the above drive control method for the motor is executed comprises a physical amount detection means, a predetermined storage means, a calculating means, and a motor rotation control means, and does not require a very complex calculating process with respect to an indication of the rotating speed of the motor. Therefore, the motor drive control apparatus, according to the present invention, does not occupy a large space, and the entire apparatus can be reduced in size even if a motor using an oil bearing is used.

Furthermore, according to the third or seventh aspect of the present invention, a time interval of a physical amount detection is changed depending on the change in the change rate serving as an index for selecting a rotating speed change characteristic. Therefore, when the physical amount sharply changes, the rotating speed of the motor is indicated at short time intervals at any time. On the other hand, when the physical amount moderately changes, the rotating speed of the motor is indicated at long time intervals. In this manner, motor drive control which more rapidly and appropriately copes with the change state can be advantageously performed.

In addition, according to the eighth aspect of the present invention, when the detected physical amount is smaller than a predetermined threshold value, and the rotating speed of the motor is higher than a predetermined lower limit value, motor drive control is performed such that rotation of the motor is gradually decelerated. Therefore, the motor is not excessively driven, and the rotation of the motor is not suddenly stopped. In this manner, the service life of the motor can be advantageously prolonged.

According to the fourth or ninth aspect of the present invention, drive control for the motor is performed in accordance with the temperature of the heat-generating member, the change in temperature change rate, and the like to operate the cooling fan. For this reason, a desired cooling operation appropriate for the change in temperature of the heat-generating member can be performed. Since the load on the bearing of the motor can be considerably reduced as described above, the service life of the cooling fan can also be advantageously prolonged.

While the invention has been particularly shown and described in reference to preferred embodiments thereof, it will be understood by those skilled in the art that changes in form and details may be made therein without departing from the spirit and scope of the invention.

What is claimed is:

1. A drive control method for a continuously rotating motor used in an adjusting device for adjusting a predetermined physical amount, comprising the steps of:

detecting the physical amount every predetermined period of time and calculating a change rate of the detected physical amount;

with respect to respective change states of the change rates, selecting a rotating speed change characteristic corresponding to the change state of the calculated change rate from rotating speed change characteristics of the continuously rotating motor determined to adjust the physical amount; and controlling drive of the continuously rotating motor on the basis of the selected rotating speed change characteristic.

2. A drive control method for a motor according to claim 1, further comprising the steps of:

storing a predetermined threshold value of the physical amount, the physical amount detected every predetermined period of time, and the calculated change rate and rotating speed of the motor in a predetermined storage;

newly calculating the change rate on the basis of the newly detected physical amount, and the physical amount stored in said storage and previously obtained at the predetermined period of time;

calculating a difference between the newly calculated change rate, and the change rate stored in said storage and previously obtained at the predetermined period of time;

calculating a difference between the newly detected physical amount and the threshold value stored in said storage; and recognizing a change state of the change rate on the basis of the newly calculated change rate, the change rate previously obtained at the predetermined period of time and stored in said storage, the difference between the change rates, and the difference between the newly detected physical amount and the threshold value to select the rotating speed change characteristic.

3. A drive control method for a motor according to claim 1 or 2, wherein the predetermined period of time is set to be a first period of time when the change rate changes at a first change rate, and the predetermined period of time is set to be a second period of time when the change rate changes at a second change rate, the first change rate being more rapid than the second change rate.

4. A drive control method for a motor according to claim 1 or 2, wherein said adjusting device is a cooling fan having a fan rotated by the motor, and the physical amount is a temperature of a heat-generating member cooled by said cooling fan.

5. A drive control apparatus for a continuously rotating motor used in an adjusting device for adjusting a predetermined physical amount, comprising:

detection means for detecting a physical amount at every predetermined period of time;

first storage means for storing a rotating speed change characteristic of the motor determined to adjust the physical amount with respect to respective change states of a change rate of the physical amount;

calculation means for calculating the change rate of the physical amount detected by said detection means, selecting a rotating speed change characteristic corresponding to a change state of the calculated change rate to read said rotating speed change characteristic from said first storage means, and outputting a first indication signal indicating a rotating speed of the continuously rotating motor on the basis of the read rotating speed change characteristic; and motor rotation control means for controlling rotation of the continuously rotating motor on the basis of the first indication signal output from said calculation means.

6. A drive control apparatus for a motor according to claim 5, further comprising second storage means for storing a predetermined threshold value of the physical amount, the physical amount being detected by said detection means, the change rate being calculated by said calculation means, and the rotating speed of the motor being indicated by the first indication signal, wherein said calculation means: (a) reads the threshold value stored in said second storage means, the physical amount previously obtained at the predetermined period of time, the change rate, and the rotating speed of the motor; (b) newly calculates the change rate on the basis of the physical amount newly detected by said detection means and the read physical amount previously obtained at the predetermined period of time; (c) calculates a difference between the newly calculated change rate and the read change rate previously obtained at the predetermined period of time and a difference between the newly detected physical amount and the read threshold value, selecting the rotating speed change characteristic on the basis of the calculated change rate, the difference between the change rates, and the difference between the newly detected physical amount and the read threshold value to read thereof from said first storage means; and (c) outputs the new first indication signal as a new rotating speed of the motor obtained by adding a change amount of the rotating speed of the motor based on the read rotating speed change characteristic to the rotating speed of the motor previously obtained at the predetermined period of time.

7. A drive control apparatus for a motor according to claim 5 or 6, wherein said calculation means outputs, to said detection means, a second indication signal for setting the predetermined period of time to be a first period of time when the change rate changes at a first change rate, and setting the predetermined period of time to be a second period of time when the change rate changes at a second change rate, the first change rate being more rapid than the second change rate, and wherein said detection means detects the physical amount at a time based on the second indication signal outputted from said calculation means.

8. A drive control apparatus for a motor according to claim 5 or 6, wherein when the physical amount newly detected by said detection means is smaller than the threshold value, said calculation means reads the physical amount previously obtained at the predetermined period of time and stored in said second storage means, newly calculates the change rate on the basis of the newly detected physical amount and the read physical amount, and reads the rotating speed of the motor previously obtained at the predetermined period of time and stored in said second storage means; and when the read rotating speed of the motor is larger than a predetermined lower limit value, said calculation means outputs the new first indication signal as a new rotating speed of the motor obtained by adding a change amount of a predetermined negative rotating speed for reducing the rotating speed of the motor to the read rotating speed of the motor.

9. A drive control apparatus for a motor according to claim 5 or 6, wherein said adjusting device is a cooling fan having a fan rotated by the motor, and wherein the physical amount is a temperature of a heat-generating member cooled by said cooling fan.

* * * * *